United States Patent [19]

Schwarz

[11] 4,078,780

[45] Mar. 14, 1978

[54] SKI SUPPORT FIXTURE

[76] Inventor: Peter W. Schwarz, 5386 Noveso Cir., Idaho Falls, Id. 83401

[21] Appl. No.: 772,918

[22] Filed: Feb. 28, 1977

[51] Int. Cl.[2] ..... B23Q 3/00

[52] U.S. Cl. ..... 269/88; 269/296; 269/321 CF; 269/321 W

[58] Field of Search ..... 269/321 W, 88, 296, 269/43, 95, 285, 286, 321 CF

[56] References Cited

U.S. PATENT DOCUMENTS

| | | | |
|---|---|---|---|
| 2,763,302 | 9/1956 | English | 269/88 |
| 2,908,403 | 10/1959 | Browder | 269/296 |
| 3,719,008 | 3/1973 | Mayers | 269/321 W |
| 3,963,234 | 6/1976 | Bejtlich | 269/321 W |

*Primary Examiner*—Robert C. Watson
*Attorney, Agent, or Firm*—Fitch, Even, Tabin & Luedeka

[57] ABSTRACT

A portable ski support fixture is disclosed which facilitates support and retention of a ski in either a flat or edgewise position for maintenance and repair of the ski, the fixture being manipulatable to a collapsed position for transporting and storage.

13 Claims, 7 Drawing Figures

SKI SUPPORT FIXTURE

The present invention relates generally to ski support fixtures, and more particularly to a novel ski support fixture which is adapted to support and retain a ski in either a flat or edgewise position to facilitate maintenance and repair of the ski.

In servicing skis, such as snow skis of either the downhill or cross-country type, it is often desirable to apply a wax coating to the lower ski surfaces which improves the skis for particular snow conditions. This is particularly so in downhill racing where the skier may spend considerable time preparing his skis for racing events. It is also desirable that sharp edges be maintained on the skis and, to this end, the edges must be sharpened periodically to obtain the desired edge control. In waxing, sharpening edges, servicing ski bindings, and other maintenance of skis, it is highly desirable that the ski may be maintained in a relatively fixed position.

Supporting and maintaining a ski in a desired position for servicing or maintenance presents a problem where the work is to be done at a location which does not have conventional clamping fixtures and the like as normally provided in shops which specialize in ski repair. Such facilities are not generally available to the public at ski sites or when a skier might wish to work on his skis, such as after a day of skiing preparatory to the next day's skiing. There thus exists the need for an efficient yet inexpensive ski support fixture for retaining and positioning skis during servicing and maintenance of the skis, which support fixture is preferably portable and may be readily prepared for working on one's skis at substantially any location.

The present invention provides a portable ski support fixture which is highly effective for supporting a ski in a generally flat condition for servicing the bottom ski surface or ski binding, or for supporting the ski on edge to facilitate maintenance of the edges of the ski, the fixture in accordance with the present invention being manipulatable to a compact collapsed position for transport and storage.

Accordingly, one of the primary objects of the present invention is to provide a portable ski support fixture which may be used to support a ski in either a generally flat position or on edge whereby to facilitate maintenance and servicing of the ski as in waxing, sharpening the edges, repairing or adjusting the ski binding, etc.

Another object of the present invention is to provide a ski support fixture which is collapsible to a compact position for transport and storage of the fixture, but which may be easily erected to support a ski in a flat or edgewise position.

A feature of the present invention lies in the provision of a hingedly mounted support plate which is adapted to support and retain a ski in a flat or edgewise position and which can readily accommodate flexing of the ski during servicing thereof.

Another feature of the present invention lies in the provision of hingedly connected hinge and brace plates which are manipulatable to position the support plate for substantially free pivotal movement to accommodate support of a ski in flat or edgewise positions.

Further objects and advantages of the present invention, together with the organization and manner of operation thereof, will become apparent from the following detailed description of the invention when taken in conjuncton with the accompanying drawings wherein like reference numerals designate like elements throughout the several views, and wherein.

Figures 1, 2, 3, 4, 5, 6, 7:
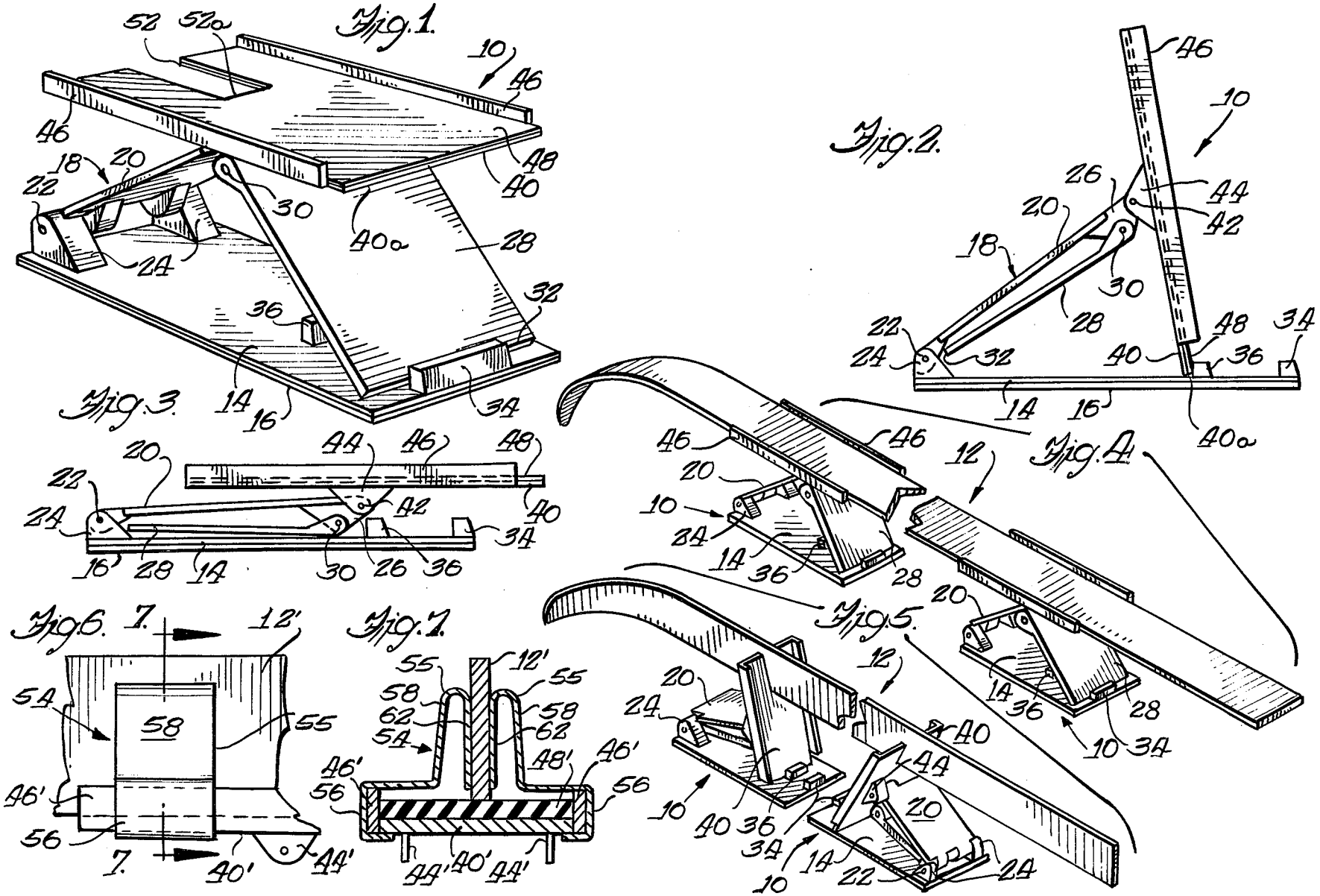
FIG. 1 is a perspective view of a ski support fixture constructed in accordance with the present invention.
FIG. 2 is a side elevational view of the ski support fixture of FIG. 1, the support plate being shown in a position to support a ski in edgewise relation.
FIG. 3 is a side elevational view of the ski support fixture in a collapsed position.
FIGS. 4 and 5 illustrate pairs of the ski support fixtures supporting a ski in flat and edgewise positions, respectively.
FIG. 6 is a partial side elevational view showing an alternative embodiment of the ski support fixture for supporting a ski in an edgewise position.
FIG. 7 is a transverse sectional view taken substantially along the line 7—7 of FIG. 6, looking in the direction of the arrows.

Referring now to the drawing, and in particular to FIGS. 1–5, a ski support fixture constructed in accordance with one embodiment of the present invention is indicated generally at 10. The ski support fixture 10 is adapted to support a ski, such as a snow ski indicated generally at 12 in FIGS. 4 and 5 and which may be of the downhill or crosscrountry type, to facilitate maintenance and servicing of the ski without removing the ski binding (not shown) therefrom. As will become more apparent hereinbelow, the ski support fixture 10 may be used either singularly or with a second similar ski support fixture to support a ski in a generally flat position, such as shown in FIG. 4, for waxing or repairing the bottom ski surface of the ski or for repairing or replacing a ski binding (not shown), or to support the ski in edgewise relation to sharpen or repair the ski edge as shown in FIG. 5.

The ski support fixture 10 includes base plate means in the form of a base plate 14 adapted to be supported on a floor or elevated work surface (not shown) during use of the ski support fixture. The base plate 14 preferably has a resilient pad 16, such as a rubber pad, secured to the bottom surface thereof for engagement with the floor or work surface upon which the ski support fixture is positioned so as to prevent marring or damage to the support surface. The pad 16 also provides a relatively high friction surface for engagement with the support surface to prevent the fixture from slipping and sliding during use. The base plate 14 may be made of plastic or other suitable material and may be provided with additional clamping means such as suction clamping pads, "C" and the like to fixedly secure the base plate in selected position during use.

The base plate 14 hingedly supports support bracket means, indicated generally at 18, in the form of a hinge plate 20 which is hingedly mounted on the base plate through a transverse hinge pin 22 the opposite ends of which are retained within upstanding laterally spaced support members 24 on the base plate. The end of the hinge plate 20 opposite the hinge connection 22 has a pair of laterally spaced flange plates 26 secured thereon to which are hingedly connected a brace plate member 28 through a transverse hinge pin 30. The brace plate 28 has a length, considered perpendicular to the hinge pin 30, slightly less than the length of the hinge plate 20 to allow the brace plate to be folded in juxtaposed relation to the hinge plate to facilitate collapsing of the hinge plate and brace plate to positions adjacent the upper surface of the base plate 14, as shown in FIG. 3.

The brace plate 28 has a free edge 32 which is positionable against a stop block 34 formed on the base plate 14 so as to maintain the hinge plate 20 and brace plate 28 in erected inclined positions relative to the base plate as shown in FIG. 1.

The ski support fixture 10 includes a support plate 40 which is hingedly connected intermediate its length to the flange plates 26 through a hinge pin 42, the hinge pin 42 being received through suitable laterally spaced brackets 44 secured to the under surface of the support plate 40. In this manner, the support plate 40, which may alternatively be termed a rocker table top, is mounted for pivotal movement about the horizontal axis 42 parallel to the plane of the base plate 14.

The support plate 40 has a pair of elongate upstanding flanges 46 secured along its lateral edges, the flanges 46 being either suitably fixedly secured to the support plate or formed integral therewith. The flanges 46 provide stop means to limit lateral sliding movement of a ski when disposed on the support plate 40 in flat relation thereon as shown in FIG. 4. The lateral width of the support plate 40 may be made of suitable size to receive one or a pair of skis in flat side-by-side relation. A support plate 40 of suitable width to support a pair of skis is particularly desirable when mounting bindings, etc., on a pair of skis so that the binding locations can be easily matched and the bindings can be mounted on both skis at substantially the same time. A resilient support pad 48 made of a suitable material such as rubber is preferably secured to the upper surface of the support plate 40 and defines a support surface to receive the ski 12 thereagainst.

With the support plate 40 and associated pad 48 hingedly secured to the hinge plate 20 generally mid-length of the support plate through the hinge pin 42, when the hinge plate 20 and brace plate 28 are disposed in their collapsed positions as in FIG. 3, the support plate 40 will lie adjacent the base plate 14 generally parallel therewith to provide a compact and portable ski support fixture for storage and transportation.

In supporting a ski 12 in a flat position for working on the bottom ski surface or on the side of the ski upon which the ski binding is mounted, the fixture 10 is manipulated to raise the hinge plate 20 and brace plate 28 so that the support plate 40 is freely pivotal about the hinge axis 42 as shown in FIG. 1. One or a pair of skis 12 may be laid on the support pad 48, depending on the selected width of the support plate, and retained laterally by the upstanding flanges 46. The support plate 40 will maintain generally full surface contact with the opposing surface of the ski 12 in supporting relation therewith independently of the angle of the longitudinal axis of the ski 12 relative to the support surface upon which the fixture 10 is disposed. As noted, it may be desirable to use two ski support fixtures 10 in supporting a ski 12 in which case a ski support fixture is disposed generally adjacent each end of the ski. The support plates 40 on the ski support fixtures allow flexing of the ski in a direction generally normal to the plane of the surface being worked on by virtue of their hinge supports.

To facilitate retention and support of a ski 12 in an edgewise position, the support plate 40 is provided with an open ended rectangular shaped recess 52 intermediate the lateral edges of the support plate. The open ended recess 52 has a bottom edge 52a providing a recess depth which is less than the lateral width of the ski 12. The recess 52 has a lateral dimension slightly greater than the thickness of the ski 12. To support a ski on edge, the hinge plate 20 and juxtaposed brace plate 28 are raised to an inclined position relative to the base plate 14 and the support plate 40 is positioned to engage an edge 40a opposite the recess 52 against a second stop 36 formed on the base plate rearwardly of the stop 34. The stop 36 is located so that when the edge 40a of the support plate 40 is positioned against stop 36, the support plate is disposed in a more vertical plane than when the support plate is disposed against stop 34. With the edge 40a of the support plate positioned against stop 36, the recess 52 extends upwardly from the base plate, as shown in FIGS. 2 and 5. With the support plate 40 disposed in an upwardly inclined position, a ski 12 may be inserted in edgewise relation within the recess 52, the recess having a depth sufficient to insure that the upper edge of the ski is disposed above the edge support plate to facilitate working on the upper edge of the ski as in sharpening the edges. The ski support fixture 10 facilitates support of the ski in edgewise relation independent of the angular relationship of the longitudinal axis of the ski relative to the support surface upon which the ski support fixture is disposed. It may also be desirable to employ a pair of the ski support fixtures with each fixture supporting an end of the ski 12 as in FIG. 5.

The various elements of the ski support fixture 10 are preferably made of a relatively high strength lightweight material such as plastic or a suitable metal.

FIGS. 6 and 7 illustrate an alternative embodiment of the ski support fixture 10. In the embodiment of FIGS. 6 and 7, a support plate 40' is partially illustrated which has laterally spaced hinge brackets 44' secured to the lower surface thereof for mounting on the hinge plate 20. The support plate 40' has upstanding lateral flanges 46' formed integral therewith or otherwise suitably secured thereto in similar fashion to the support plate 40. In the embodiment of FIGS. 5 and 6, separable mounting bracket means, indicated generally at 54, are provided for mounting on the support table 40' to receive and support a ski 12' in edgewise relation on the support plate for working on the edge of the ski. The separable mounting bracket means 54 includes a pair of identically shaped adapter brackets 55 each of which has a generally C-shaped base 56 having an internal configuration suitable to be frictionally received over a lateral edge of the support plate 40' and the associated upstanding lateral flanges 46' so as to be frictionally retained thereon. Each adapter bracket 55 has an upstanding generally inverted U-shaped arm 58 formed integral with the base 56. The arms 58 have depending wall portions 62 which are spaced in opposed relation when the adapter brackets 55 are mounted on the support plate 40' so that the walls 62 receive the ski 12' in edgewise relation therebetween in biased engagement therewith. The adapter brackets 55 may be made of plastic, metal or other suitable material.

During use of the adapter brackets 55, the support plate 40' is maintained in generally horizontal relation. The adapter brackets 55 may be removed from the associated support plate 40' to facilitate positioning of a ski in flat position upon the support plate 40' between the upstanding lateral flanges 46' to facilitate work on the flat surfaces of the ski.

Thus, in accordance with the present invention, a portable ski support fixture is provided which greatly enhances and facilitates maintenance of skis without removing the ski bindings therefrom, the fixture being adapted for positioning a ski in both a flat position, as when waxing or repairing the bottom ski surface or working on the ski binding, and in an edgewise position, as when sharpening or otherwise servicing the edge of the ski.

While preferred embodiments of the present invention have been illustrated and described, it will be obvious to those skilled in the art that changes and modifications may be made therein without departing from the invention in its broader aspects. Various features of the invention are defined in the following claims.

What is claimed is:

1. A ski support fixture to facilitate the maintenance of a ski, said fixture comprising a base plate adapted to be supported on a floor or elevated work surface, support bracket means mounted on said base plate and adapted to extend upwardly therefrom, a brace member hingedly connected to said support bracket means and having a free edge, stop means mounted on said base plate, a support plate hindedly connected to said support bracket for pivotal movement about an axis parallel to said base plate, said support bracket means and brace member being manipulatable to dispose said free end of said brace member against said stop member with said brace member inclined upwardly from said base plate and with said support plate spaced above said base plate, said support plate having a support surface thereon adapted to receive at least one ski in flat position thereagainst and having stop means laterally of said support surface to limit lateral movement of the ski on said support surface and facilitate maintenance of the ski independent of the angle of inclination of the longitudinal axis of the ski relative to the surface on which said fixture is supported, said support bracket means and brace member being manipulatable to lie substantially against said base plate with said support plate being substantially parallel to said base plate.

2. A ski support fixture as defined in claim 1 wherein said support plate comprises a U-shaped member defining upstanding laterally spaced flanges which constitute said stop means laterally of said support surface.

3. A ski support fixture as defined in claim 1 wherein said support surface comprises a resilient pad supported on said support plate between said lateral stop means.

4. A ski support fixture as defined in claim 1 including a resilient pad secured to said base plate for engagement with the surface upon which said fixture is supported, said resilient pad presenting a high friction surface for engagement with said support surface to facilitate nonslipping of the fixture during usage.

5. A ski support fixture as defined in claim 1 wherein said support plate has a lateral width sufficient to support a pair of skis in flat side-by-side relation thereon.

6. A ski support fixture as defined in claim 1 wherein said base plate, support bracket means and support plate are made of plastic material.

7. A ski support fixture to facilitate the maintenance of a ski, said fixture comprising a base plate adapted to be supported on a floor or elevated work surface, support bracket means mounted on said base plate and adapted to extend upwardly therefrom, and a support plate hingedly connected to said support bracket for pivotal movement about an axis parallel to said base plate, said support plate having a support surface thereon adapted to receive at least one ski in flat position thereagainst and having stop means laterally of said support surface to limit lateral movement of the ski on said support surface and facilitate maintenance of the ski independent of the angle of inclination of the longitudinal axis of the ski relative to the surface of which said fixture is supported, said support plate including means to facilitate support of a ski in edgewise relation thereon for working on a longitudinal edge of the ski.

8. A ski support fixture as defined in claim 7 wherein said means on said support plate for supporting a ski in edgewise relation comprises an open ended recess in said support plate, said support plate being positionable such that said recess is adapted to receive a ski therein in edgewise relation with an edge of the ski lying above the open end of said notch.

9. A support fixture as defined in claim 7 wherein said means to facilitate support of a ski in edgewise relation includes separable mounting bracket means mountable on said support plate, said mounting bracket means having upstanding spaced arms thereon defining an open ended recess therebetween adapted to receive a ski therein in edgewise position.

10. A ski support fixture as defined in claim 8 wherein said base plate has stop means thereon, said support plate being hingedly connected to said support bracket means generally intermediate to its length so as to define at least one free end on said support plate, said support plate being pivotal about said hinge axis to engage said free end with said stop means on said base plate whereby to maintain said support plate in an upwardly inclined position relative to said base plate with said open end of said notch directed upwardly.

11. A portable ski support fixture to faciliate maintenance of a ski without removing the ski binding therefrom, said fixture comprising a base plate adapted to be supported on a floor or elevated work surface, support bracket means hingedly mounted on said base plate for movement between raised and lowered positions relative to said base plate, and a support plate hingedly connected to said support bracket means for pivotal movement about an axis parallel to the plane of said base plate, said support plate including means adapted to receive and support a ski in edgewise relation to facilitate maintenance of the edges of the ski independent of the angle of inclination of the longitudinal axis of the ski relative to the plane of the surface upon which said fixture is supported.

12. A ski support fixture as defined in claim 11 wherein said means on said support plate adapted to receive and support a ski in edgewise relation thereon comprises an open ended recess formed in said support plate, said support plate being pivotal to a position wherein said open end of said recess is directed upwardly relative to said base plate, and said recess being of sufficient size to receive and support a ski therein in edgewise relation.

13. A ski support fixture as defined in claim 11 including a brace member hingedly connected to said support bracket means and having a free edge, said base plate having stop means thereon, and said brace member and support member being manipulatable to dispose said free edge of said brace member against said stop member with said support bracket spaced from said base plate, said support bracket means and brace member being manipulatable to lie substantially against said base plate with said support plate disposed parallel to said base plate proximate thereto.

* * * * *